US010137585B2

(12) United States Patent
Gonterman

(10) Patent No.: US 10,137,585 B2
(45) Date of Patent: Nov. 27, 2018

(54) RAZOR ASSEMBLY

(71) Applicant: Paula Gonterman, San Rafael, CA (US)

(72) Inventor: Paula Gonterman, San Rafael, CA (US)

( * ) Notice: Subject to any disclaimer, the term of this patent is extended or adjusted under 35 U.S.C. 154(b) by 0 days.

(21) Appl. No.: 15/341,095

(22) Filed: Nov. 2, 2016

(65) Prior Publication Data

US 2018/0117781 A1 May 3, 2018

(51) Int. Cl.
*B26B 21/52* (2006.01)
*B26B 21/22* (2006.01)
*B26B 21/44* (2006.01)

(52) U.S. Cl.
CPC ..... *B26B 21/522* (2013.01); *B26B 21/222* (2013.01); *B26B 21/225* (2013.01); *B26B 21/443* (2013.01); *B26B 21/521* (2013.01); *B26B 21/525* (2013.01); *B26B 21/527* (2013.01)

(58) Field of Classification Search
CPC ... B26D 21/522; B26B 21/527; B26B 21/225; B26B 21/443; B26B 21/521; B26B 21/525
USPC ..... 30/50, 51, 541, 298
See application file for complete search history.

(56) References Cited

U.S. PATENT DOCUMENTS 5,457,887 A * 10/1995 Grange ..... A45D 27/29 30/34.05
5,903,978 A * 5/1999 Prochaska ..... A45D 27/29 30/34.05
6,018,877 A 2/2000 Greene
6,029,356 A 2/2000 Sprinkle
6,493,950 B1 12/2002 Kludjian et al.
6,550,148 B2 4/2003 Cecil
D481,169 S 10/2003 Cheung
7,140,115 B2 11/2006 Greene
D542,104 S * 5/2007 Holcomb ..... B26B 21/521 D7/695
2008/0072430 A1* 3/2008 Cafaro ..... B26B 19/06 30/45
2012/0297625 A1* 11/2012 Madden ..... B26B 21/521 30/42
2013/0255455 A1* 10/2013 McCue ..... B26B 19/06 83/13
2014/0290066 A1* 10/2014 Woolfson ..... B26B 21/527 30/50
2015/0183119 A1 7/2015 Contaldi
2015/0257604 A1* 9/2015 Heyden ..... A47J 43/14 30/120.1
2016/0151924 A1* 6/2016 Gers-Barlag ..... B26B 21/52 30/34.05

FOREIGN PATENT DOCUMENTS

WO WO2012107713 8/2012

* cited by examiner

*Primary Examiner* — Omar Flores Sanchez

(57) ABSTRACT

A razor assembly for shaving with an open palm includes a grip. The grip may be positioned in a palm of a hand thereby facilitating the grip to inhibit symptoms of tendonitis. A blade unit is removably coupled to the grip. Thus, the blade unit may shave hair.

7 Claims, 5 Drawing Sheets

RAZOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to razor devices and more particularly pertains to a new razor device for shaving with an open palm.

BRIEF SUMMARY OF THE INVENTION

An embodiment of the disclosure meets the needs presented above by generally comprising a grip. The grip may be positioned in a palm of a hand thereby facilitating the grip to inhibit symptoms of tendonitis. A blade unit is removably coupled to the grip. Thus, the blade unit may shave hair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
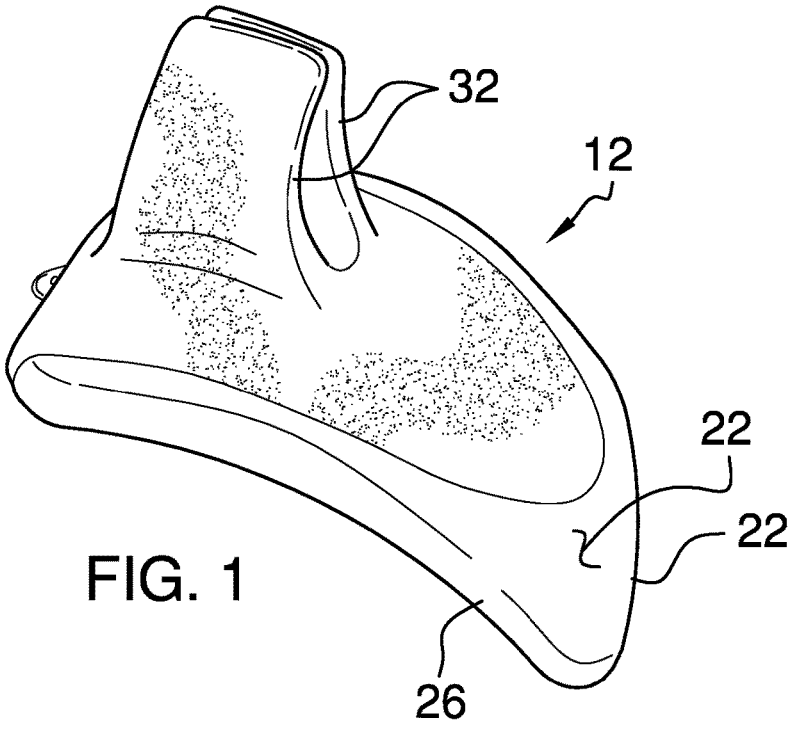
FIG. 1 is a perspective view of a grip of a razor assembly according to an embodiment of the disclosure.
Figure 2:
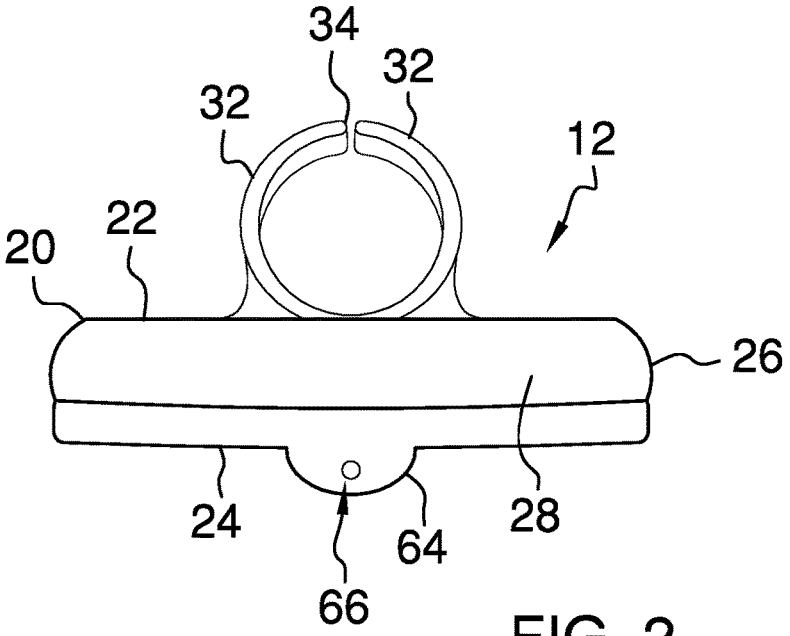
FIG. 2 is a front view of grip of an embodiment of the disclosure.
Figure 3:
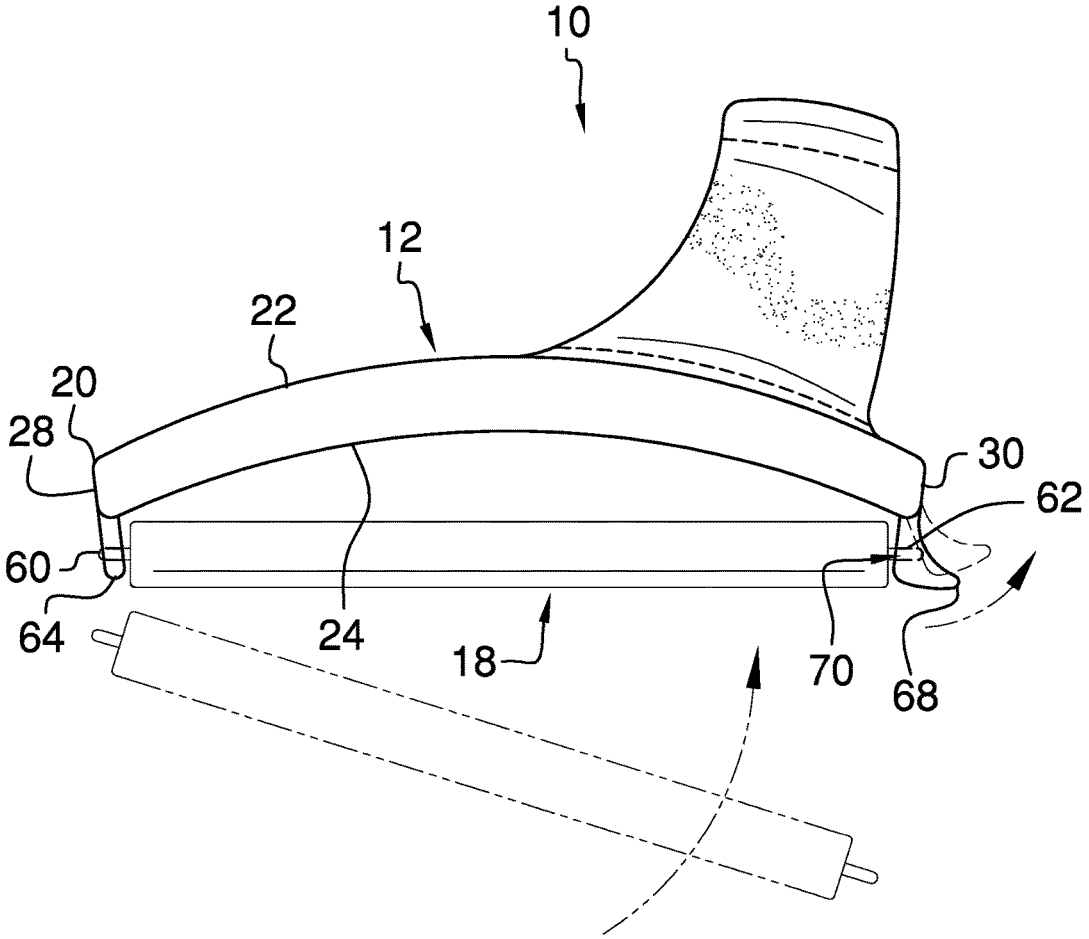
FIG. 3 is a right side view of an embodiment of the disclosure.
Figure 4:
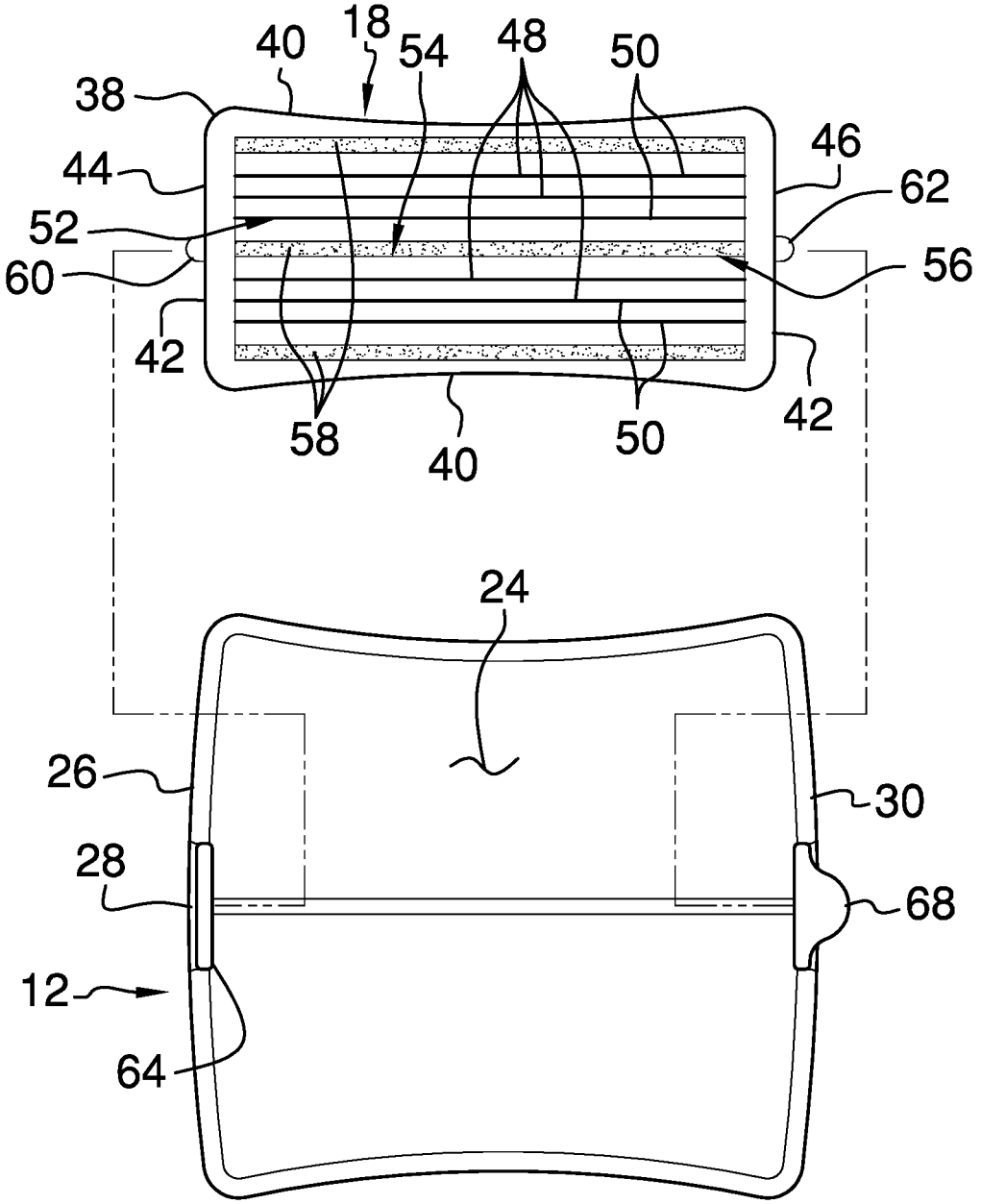
FIG. 4 is a bottom exploded view of an embodiment of the disclosure.
Figure 5:
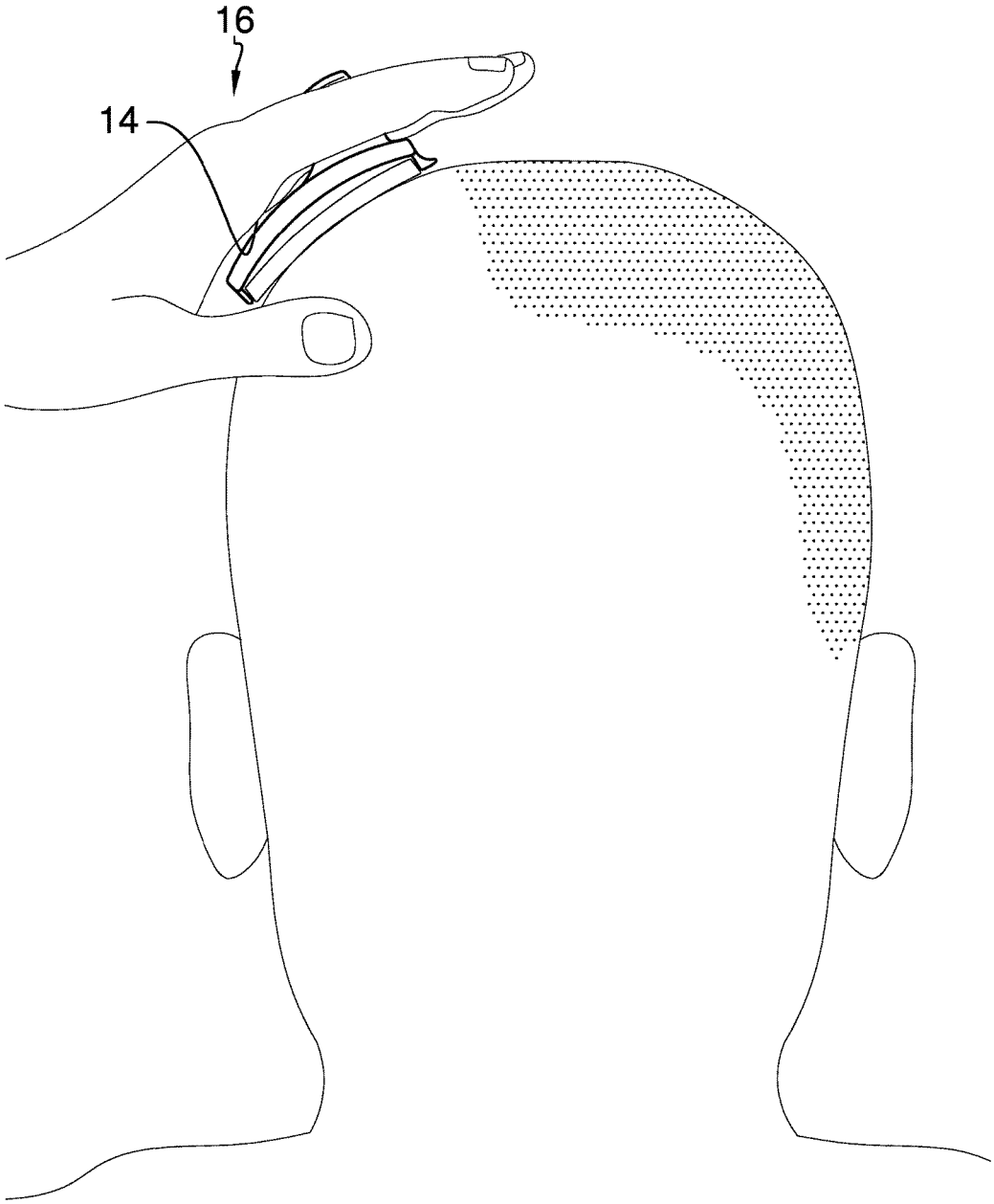
FIG. 5 is a perspective in-use view of an embodiment of the disclosure.
Figure 6:
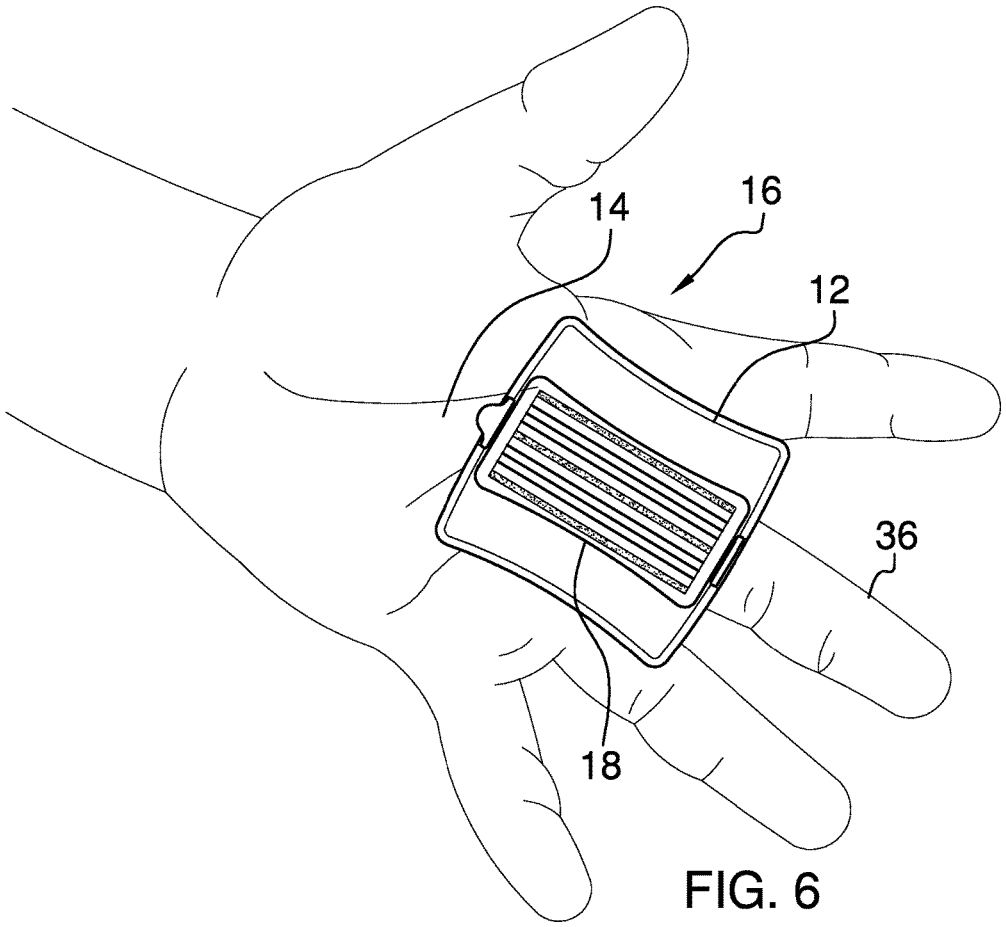
FIG. 6 is a bottom perspective in-use view of an embodiment of the disclosure.

With reference now to the drawings, and in particular to FIGS. 1 through 6 thereof, a new razor device embodying the principles and concepts of an embodiment of the disclosure and generally designated by the reference numeral 10 will be described.

As best illustrated in FIGS. 1 through 6, the razor assembly 10 generally comprises a grip 12. The grip 12 may be positioned in a palm 14 of a hand 16 thereby facilitating the grip 12 to inhibit symptoms of tendonitis. A blade unit 18 is provided and the blade unit 18 is removably coupled to the grip 12. Thus, the blade unit 18 may shave hair. The hair may be whiskers or the like.

The grip 12 comprises a panel 20 that has a first surface 22, a second surface 24 and a peripheral edge 26 extending therebetween. The peripheral edge 26 has a first lateral side 28 and a second lateral side 30. Moreover, the panel 20 is concavely arcuate between the first lateral side 28 and the second lateral side 30. Thus, the panel 20 conforms to the palm 14 of the hand 16 thereby enhancing gripping the panel 20.

A pair of horns 32 is provided. Each of the horns 32 is coupled to and extends upwardly from the first surface 22. The horns 32 are spaced apart from each other. Each of horns 32 has a distal end 34 with respect to the first surface 22.

Each of the horns 32 is concavely arcuate between the first surface 22 and the distal end 34. Thus, each of the pair of horns 32 forms an open ring. Each of the horns 32 may engage a finger 36 thereby facilitating the panel 20 to be retained on the palm 14. Moreover, each of the horns 32 is positioned closer to the second lateral side 30 than the first lateral side 28.

The blade unit 18 includes a frame 38. The frame 38 has a pair of first members 40 extending between each of a pair of second members 42. The first members 40 are spaced apart from each other such that the frame 38 forms a rectangle. The pair of second members 42 includes a primary member 44 and a secondary member 46. A plurality of blades 48 is provided. The blades 48 are coupled between each of the second members 42. Each of the blades 48 has a cutting edge 50.

The plurality of blades 48 includes a first set of blades 52 and a second set of blades 54. Each of the first set of blades 52 and each of the second set of blades 54 are spaced from a center 56 of the frame 38. The cutting edge 50 corresponding to the first set of blades 52 is directed toward the center 56 of the frame 38. The cutting edge 50 corresponding to the second set of blades 54 is directed toward the center 56 of the frame 38.

A plurality of lubrication strips 58 is provided. Each of the lubrication strips 58 is coupled between the second members 42. Moreover, the lubrication strips 58 are spaced apart from each other and distributed between the first set of blades 52 and the second set of blades 54. Each of the lubrication strips 58 enhances comfort of the blades 48. A first pin 60 is coupled to and extends away from the primary member 44. A second pin 62 is coupled to and extends away from the secondary member 46.

A first tab 64 is coupled to and extends away from the second surface 24 of the panel 20. The first tab 64 is aligned with the first lateral side 28 of the panel 20. A first opening 66 extends through the first tab 64. The first pin 60 on the blade unit 18 extends through the first opening 66.

A second tab 68 is provided. The second tab 68 is coupled to and extends away from the second surface 24 of the panel 20. The second tab 68 is aligned with the second lateral side 30 of the panel 20. A second opening 70 extends through the second tab 68.

The second pin 62 on the blade unit 18 extends through the second tab 68. Thus, the blade unit 18 is retained on the grip 12. The second tab 68 is comprised of a resiliently bendable material. Thus, the second tab 68 may be urged away from the blade unit 18 thereby facilitating the blade unit 18 to be removed from the panel 20.

In use, the blade unit 18 is coupled between the first tab 64 and the second tab 68. The finger 36 is extended between each of the horns 32 and the panel 20 is positioned on the palm 14. The grip 12 is manipulated thereby facilitating each of the blades 48 to shave hair. The grip 12 facilitates the blade unit 18 to be manipulated with an open palm 14. Thus, the grip 12 inhibits symptoms of carpal tunnel or the like from being aggravated by shaving with a closed hand 16.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A razor assembly being configured to be removably positioned in a palm thereby facilitating a razor to shave hair, said assembly comprising:

a grip being configured to be positioned in a palm of a hand thereby facilitating said grip to inhibit symptoms of tendonitis, said grip including a panel having a first surface, a second surface and a peripheral edge extending therebetween, said peripheral edge having a first lateral side and a second lateral side, said panel being concavely arcuate between said first lateral side and said second lateral side wherein said panel is configured to conform to a palm of a hand; and a blade unit being removably coupled to said grip wherein said blade unit is configured to shave hair, said blade unit including a frame, said frame having a pair of first members extending between each of a pair of second members, a plurality of blades being coupled between each of said second members, said plurality of blades being arranged to include a first set of blades and a second set of blades, said first set of blades and said second set of blades each being positioned on opposite sides of a center of said frame, each blade of said first set of blades and said second set of blades having a cutting edge directed towards said center of said frame.

2. The assembly according to claim 1, further comprising a pair of horns, each of said horns being coupled to and extending upwardly from said first surface, said horns being spaced apart from each other, each of horns having a distal end with respect to said first surface.

3. The assembly according to claim 2, wherein each of said horns is concavely arcuate between said first surface and said distal end such that said pair of horns forms an open ring wherein each of said horns is configured to engage a finger thereby facilitating said panel to be retained on the palm, each of said horns being positioned closer to said second lateral side than said first lateral side.

4. The assembly according to claim 1, further comprising a first tab being coupled to and extending away from said second surface of said panel, said first tab being aligned with said first lateral side of said panel, said first tab being configured to engage said blade unit.

5. The assembly according to claim 4, further comprising a second tab being coupled to and extending away from said second surface of said panel, said second tab being aligned with said second lateral side of said panel, said second tab engaging said blade unit thereby facilitating the razor to be removably retained on said panel.

6. The assembly according to claim 5, wherein said second tab is comprised of a resiliently bendable material wherein said second tab is configured to be manipulated thereby facilitating the blade unit to be removed from said panel.

7. A razor assembly being configured to be removably positioned in a palm thereby facilitating a razor to shave hair, said assembly comprising:

a grip being configured to be positioned in a palm of a hand thereby facilitating said grip to inhibit symptoms of tendonitis, said grip being configured to selectively engage a razor thereby facilitating the razor to shave hair, said grip comprising:

a panel having a first surface, a second surface and a peripheral edge extending therebetween, said peripheral edge having a first lateral side and a second lateral side, said panel being concavely arcuate between said first lateral side and said second lateral side wherein said panel is configured to conform to a palm of a hand, a pair of horns, each of said horns being coupled to and extending upwardly from said first surface, said horns being spaced apart from each other, each of horns having a distal end with respect to said first surface, each of said horns being concavely arcuate between said first surface and said distal end such that said pair of horns forms an open ring wherein each of said horns is configured to engage a finger thereby facilitating said panel to be retained on the palm, each of said horns being positioned closer to said second lateral side than said first lateral side, a first tab being coupled to and extending away from said second surface of said panel, said first tab being aligned with said first lateral side of said panel, said first tab being configured to engage an end of the razor, and a second tab being coupled to and extending away from said second surface of said panel, said second tab being aligned with said second lateral side of said panel, said second tab being configured to engage an end of the razor thereby facilitating the razor to be removably retained on said panel, said second tab being comprised of a resiliently bendable material wherein said second tab is configured to be urged away from the razor thereby facilitating the razor to be removed from said panel; and a blade unit being removably coupled to said grip wherein said blade unit is configured to shave hair, said blade unit including a frame, said frame having a pair of first members extending between each of a pair of second members, a plurality of blades being coupled between each of said second members, said plurality of blades being arranged to include a first set of blades and a second set of blades, said first set of blades and said second set of blades each being positioned on opposite sides of a center of said frame, each blade of said first set of blades and said second set of blades having a cutting edge directed towards said center of said frame.

* * * * *